US006149704A

United States Patent [19]

Moro et al.

[11] Patent Number: 6,149,704

[45] Date of Patent: Nov. 21, 2000

[54] FERROMAGNETIC POWDER FOR DUST CORES, DUST CORE, AND DUST CORE FABRICATION PROCESS

[75] Inventors: Hideharu Moro; Takeo Tsukada; Katsuhiko Wakayama, all of Tokyo, Japan

[73] Assignee: TDK Corporation, Tokyo, Japan

[21] Appl. No.: 09/362,709

[22] Filed: Jul. 29, 1999

[30] Foreign Application Priority Data

Jul. 29, 1998 [JP] Japan ..... 10-228668

[51] Int. Cl.[7] ..... B22F 3/02

[52] U.S. Cl. ..... 75/230; 75/252; 75/246; 148/104; 148/306; 252/62.53; 252/62.54; 419/66

[58] Field of Search ..... 75/252, 230, 246; 148/104, 306; 252/62.53, 62.54; 419/66

[56] References Cited

U.S. PATENT DOCUMENTS

| | | | |
|---|---|---|---|
| 4,184,972 | 1/1980 | Pevzner et al. | 252/62.54 |
| 4,308,155 | 12/1981 | Tada et al. | 252/62.54 |
| 5,039,559 | 8/1991 | Sang et al. | 427/213.3 |
| 5,651,841 | 7/1997 | Moro et al. | 148/309 |
| 5,702,630 | 12/1997 | Sasaki et al. | 252/62.52 |
| 5,800,636 | 9/1998 | Tsukada et al. | 148/306 |
| 5,980,603 | 11/1999 | Thomas et al. | 75/252 |

FOREIGN PATENT DOCUMENTS

| | | |
|---|---|---|
| 28 27 490 | 1/1980 | Germany . |
| 56-155510 | 12/1981 | Japan . |
| 61-288403 | 12/1986 | Japan . |
| 7-211531 | 8/1995 | Japan . |
| 7-211532 | 8/1995 | Japan . |

*Primary Examiner*—Ngoclan Mai

*Attorney, Agent, or Firm*—Oblon, Spivak, McClelland, Maier & Neustadt, P.C.

[57] ABSTRACT

A dust core ferromagnetic powder comprises a ferromagnetic metal powder, an insulating material, and a lubricant. The insulating material comprises a phenol resin and/or a silicone resin, and the lubricant comprises at least one compound selected from the group consisting of magnesium stearate, calcium stearate, strontium stearate, and barium stearate. It is possible to achieve a dust core having high saturation magnetic flux density, low losses, and satisfactory permeability with its dependence on frequency being improved.

14 Claims, No Drawings

FERROMAGNETIC POWDER FOR DUST CORES, DUST CORE, AND DUST CORE FABRICATION PROCESS

BACKGROUND OF THE INVENTION

The present invention relates to a dust core used as magnetic cores for transformers, inductors, etc., cores for motors, and used for other electromagnetic parts, a powder used for the fabrication of the dust core, and a process for the fabrication of the dust core.

Recent size reductions of electric, and electronic equipment have resulted in the need of small-size yet high-efficient dust cores. For a dust core, ferrite powders, and ferromagnetic metal powders are used. The ferromagnetic metal powders are higher in saturation magnetic flux density than the ferrite powders, and so enable core size to become small. However, low electric resistance gives rise to an increase in the eddy current loss of the resulting core. For this reason, insulating coatings are usually provided on the surfaces of ferromagnetic metal particles in the dust core.

In an ordinary dust core fabrication process, annealing is generally carried out after molding because coercive force is increased by stresses induced during molding, resulting in a failure in obtaining high permeability and an increased hysteresis loss. To provide sufficient release of stresses from ferromagnetic metal particles, they must be annealed at a high temperature (of, e.g., 550° C. or higher). So far, phenol or silicone resin having relatively high heat resistance has often been used as an insulating material. Even when these resins are used, however, insulation between the ferromagnetic metal particles becomes poor because of increased resin losses upon a thermal treatment at 550° C. or greater. The poor insulation in turn gives rise to some noticeable eddy current losses in a high-frequency region, resulting in increased core losses and causing the dependence of permeability on frequency to become worse.

An object of the present invention is to achieve a dust core having high saturation magnetic flux density, low losses, and satisfactory permeability with its dependence on frequency being improved.

SUMMARY OF THE INVENTION

Such an object is achieved by the inventions defined below as (1) to (4).

(1) A dust core ferromagnetic powder comprising a ferromagnetic metal powder, an insulating material, and a lubricant, wherein:

said insulating material comprises a phenol resin and/or a silicone resin, and said lubricant comprises at least one compound selected from the group consisting of magnesium stearate, calcium stearate, strontium stearate, and barium stearate.

(2) The dust core ferromagnetic powder according to (1), which further comprises a titanium oxide sol and/or a zirconium oxide sol.

(3) A dust core, which is obtained by compression molding of the dust core ferromagnetic powder as recited in (1) or (2).

(4) A dust core fabrication process which comprises steps of subjecting the dust core ferromagnetic powder as recited in (1) or (2) to compression molding, and then thermally treating a ferromagnetic core compact at 550 to 850° C.

The dust core ferromagnetic powder of the invention comprises a ferromagnetic metal powder higher in saturation magnetic flux density than ferrite, and further comprises an insulating material and a lubricant. In the invention, at least the phenol resin and/or the silicone resin are used as the insulating material, and at least the above specific compound selected from divalent metal salts of stearic acid is used as the lubricant.

Even when the dust core of the invention obtained by the compression molding of the dust core ferromagnetic powder is annealed at 550 to 850° C. for the purpose of improving its magnetic properties, it is less susceptible to insulation degradation. If the insulating material or the phenol or silicone resin is used singly, i.e., not in combination with the aforesaid specific divalent metal salt of stearic acid, the insulation degradation takes place upon annealing at high temperatures. This result appears to teach that the specific divalent metal salt of stearic acid has an effect on reducing resin losses upon high-temperature annealing. The invention is the first to find this fact.

Thus, the invention achieves both the effects by high-temperature annealing, i.e., the effects on reducing hysteresis losses and permeability degradation due to release of stresses induced during pulverization and molding from the ferromagnetic metal powder, and the effects by the retention of insulation, i.e., the effects on reducing eddy current loss and improving the dependence of permeability on frequency. Accordingly, the dust core of the invention has limited total loss (core losses), and is satisfactory in terms of permeability and the dependence of permeability on frequency.

Some examples of the dust core using a phenol or silicone resin as an insulating material are shown in the following publications.

JP-A 56-155510 discloses a metal dust core obtained by molding under pressure metal magnetic powders with at least one of water glass and organic resin insulators and 0.2 to 2.0% of zinc stearate added thereto, and heating the molded compact. Regarding the effect of zinc stearate, the publication refers only to a reduction of inter-granular friction. In Example 2 of the publication, water glass and phenolic resin are added to pure iron powders. The powders are then molded under a pressure of 7 t/cm$^2$ with zinc stearate added thereto, and then thermally treated at 150° C. for 30 minutes to obtain a metal dust core. According to the invention set forth in the publication, insulation degradation occurs upon high-temperature annealing at 550° C. or higher, because, unlike the present invention, zinc stearate is used as the lubricant. In the example of the publication wherein the thermal treatment is carried out at a temperature of as low as 150° C., the dependence of permeability on frequency is improved with no insulation degradation. With such low-temperature treatment, however, no sufficiently enhanced permeability is obtained because the release of stresses from the metal magnetic powders becomes insufficient.

JP-A 61-288403 discloses a dust core obtained by molding under pressure, and curing pure iron powders atomized down to 60 meshes or less, with 1 to 5% by volume of phenol resin added thereto. In the example of the publication, pure iron powders with phenol resin and a zinc stearate lubricant added thereto are molded under a pressure of 5 t/cm$^2$, and then cured at 80° C. for 2 hours and at 180° C. for 2 hours to obtain a dust core. In this publication, too, the advantages of the present invention are not achievable because, as in JP-A 56-155510, zinc stearate is used as the lubricant. In addition, no sufficient permeability is obtained because the curing temperature is low.

JP-A's 7-211531 and 7-211532 disclose a dust core comprising alloy powders composed mainly of Fe, Si and Al, silicone resin, and stearic acid. In the example of each publication, molding is carried out under a pressure of 10 t/cm$^2$, followed by a 2-hour thermal treatment at 700° C. in the air or an Ar atmosphere. Unlike the present invention, stearic acid is used as the lubricant in each publication. When stearic acid is used, insulation degradation occurs upon thermal treatment at high temperatures.

EMBODIMENTS OF THE INVENTION

Ferromagnetic Powder for Dust Core

The dust core ferromagnetic powder according to the invention comprises a ferromagnetic metal powder, an insulating material, and a lubricant.

Lubricant

The lubricant is added to the ferromagnetic powders for the purpose of enhancing inter-granular lubrication, and improving mold release characteristics. In the invention, at least one compound selected from the group consisting of magnesium stearate, calcium stearate, strontium stearate, and barium stearate, among which strontium stearate is most preferred.

The content of these divalent metal salts of stearic acid in the ferromagnetic metal powders should be preferably 0.2 to 1.5% by weight, and more preferably 0.2 to 1.0% by weight. At too low a content, insulation between the ferromagnetic metal particles in the dust core becomes poor. In addition, there are some inconveniences such as an awkward release of the core from the mold upon molding. At too high a content, on the other hand, both permeability and magnetic flux density decrease due to an increase in the proportion of non-magnetic components in the dust core. In addition, the strength of the core becomes insufficient.

It is here noted that the dust core ferromagnetic powders of the invention may contain, in addition to the aforesaid divalent metal salt of stearic acid, divalent metal salts of other higher fatty acids, especially a divalent metal salt of lauric acid. However, the content of this divalent metal salt should be less than 30% by weight of the content of the aforesaid divalent metal salt of stearic acid.

Insulating Material

In the invention, at least the phenol resin and/or the silicone resin are used as the insulating material.

The phenol resin is synthesized by the reaction of phenols with aldehydes. When a base catalyst is used for the synthesis, a resol type resin is obtained, and when an acid catalyst is used, a novolak type resin is obtained. The resol type resin is cured by heating or an acid catalyst into an insoluble and infusible state. The novolak type resin is a soluble and fusible resin that is not thermally cured in itself, but cured by heating with a crosslinking agent added thereto.

In the invention, it is preferable to use the resol type resin as the phenol resin. Among resol type resins usable herein, those containing N in a tertiary amine form are particularly preferred because they are of good heat resistance. On the other hand, the novolak type resin yields a molded compact that is of low strength and so is difficult to handle at steps subsequent to molding. When the novolak type resin is used, therefore, it should preferably be molded (or hot-pressed, etc.) with the application of temperature thereto. The molding temperature used in this case is usually of the order of 150 to 400° C. It is here noted that the novolak type resin should preferably contain a crosslinking agent.

Referring to the raw materials used for the synthesis of the phenol resin, for instance, at least one phenol selected from phenol, cresols, xylenols, bisphenol A, and resorcins should preferably be used in combination with at least one aldehyde selected from formaldehyde, p-formaldehyde, acetaldehyde, and benzaldehyde.

The phenol resin should have a weight-average molecular weight of preferably 300 to 7,000, more preferably 500 to 7,000, and even more preferably 500 to 6,000. The smaller the weight-average molecular weight, the higher the strength of the molded compact is, and the less susceptible the edge portion of the molded compact is to dusting. At a weight-average molecular weight of less than 300, however, resin losses increase upon annealing at high temperatures, resulting in a failure in maintaining insulation between the ferromagnetic metal particles in the dust core.

For the phenol resin, use may be made of commercially available phenol resins such as BRS-3801, ELS-572, ELS-577, ELS-579, ELS-580, ELS-582, and ELS-583, all made by Showa Kobunshi Co., Ltd. and being of the resol type, and BRP-5417 (of the novolak type), made by the same firm.

The silicone resin used herein should preferably have a weight-average molecular weight of about 700 to 3,300.

The total content of the phenol resin and silicone resin should preferably be 1 to 30% by volume, and especially 2 to 20% by volume relative to the ferromagnetic metal powders. Too little resins cause a mechanical strength drop of the core, and poor insulation. Too much resins, on the other hand, make the proportion of non-magnetic components in the dust core high and so make the permeability and magnetic flux density of the core low.

In the invention, it is usually preferable that the phenol resin, and the silicone resin are used alone. If required, however, it is acceptable to use them together at any desired quantitative ratio.

When the insulating resin is mixed with the ferromagnetic metal powders, the resin, either solid or liquid, may be put into a solution state for mixing. Alternatively, the liquid resin may be mixed directly with the ferromagnetic metal powders. The liquid resin should have a viscosity at 25° C. of preferably 10 to 10,000 CPS, and more preferably 50 to 9,000 CPS. Too low or high a viscosity makes it difficult to form uniform coatings on the surfaces of the ferromagnetic metal powders.

It is here noted that the aforesaid insulating resin may also function as a sort of binder, resulting in an increase in the mechanical strength of the core.

In the invention, the organic insulating material comprising the aforesaid resin may be used in combination with an inorganic insulating material. A titanium oxide sol and/or a zirconium oxide sol are preferred for the inorganic insulating material. The titanium oxide sol is a colloidal dispersion in which negatively charged amorphous titanium oxide particles are dispersed in water or an organic dispersing medium, and the zirconium oxide sol is a colloidal dispersion in which negatively charged amorphous zirconium oxide particles are dispersed in water or an organic dispersing medium. In the former dispersion, a —TiOH group is present on the surface of each particle, and in the latter dispersion, a —ZrOH group is present on the surface of each particle. By adding to the ferromagnetic metal powders a sol in which minute particles are uniformly dispersed in a solvent as in the case of the titanium oxide sol or zirconium oxide sol, it is possible to form uniform insulating coatings in small amounts and, hence, achieve high magnetic flux density and high insulation.

The titanium oxide particles, and zirconium oxide particles contained in the sol should have an average particle size of preferably 10 to 100 nm, more preferably 10 to 80 nm, and even more preferably 20 to 70 nm. The content of the particles in the sol should preferably be of the order of 15 to 40% by weight.

The amount, as calculated on a solid basis, of the titanium oxide sol, and zirconium oxide sol added to the ferromagnetic metal powders, i.e., the total amount of the titanium oxide and zirconium oxide particles should be preferably up to 15% by volume, and more preferably up to 5.0% by volume. When the total amount is too large, the proportion of non-magnetic components in the dust core increases, resulting in permeability and magnetic flux density drops. To take full advantage of the effect by the addition of these sols, the above total content should be preferably at least 0.1% by volume, more preferably at least 0.2% by volume, and even more preferably at least 0.5% by volume.

The titanium oxide sol, and the zirconium oxide sol may be used either singly or in combination at any desired quantitative ratio.

For these sols, use may be made of commercially available sol products, for instance, NZS-20A, NZS-30A, and NZS-30B, all made by Nissan Chemical Industries, Ltd. When the pH values of available sols are low, they should preferably be regulated to approximately 7. At a low pH value, the proportion of non-magnetic oxides increases due to the oxidization of the ferromagnetic metal powders, often resulting in permeability and magnetic flux density drops, and coercive force degradation.

These sols are broken down into two types, one using an aqueous solvent and the other using a non-aqueous solvent. In the invention, however, it is preferable to rely on a sol using a solvent compatible with the aforesaid resin. In particular, it is preferable to rely on a sol using a non-aqueous solvent such as ethanol, butanol, toluene, and xylene. When an available sol uses an aqueous solvent, the solvent may be substituted by a non-aqueous solvent if required.

Additionally, the sol may contain chlorine ions, ammonia, etc. as a stabilizer.

These sols are usually present in a milk white colloidal state.

Ferromagnetic Metal Powder

No particular limitation is imposed on the ferromagnetic metal powders used herein; for instance, an appropriate selection may be made depending on the purpose from known magnetic metal materials such as iron, sendust (Fe—Al—Si), iron silicide, permalloy (Fe—Ni), superalloy (Fe—Ni—Mo), iron nitride, iron-aluminum alloy, iron-cobalt alloy, and phosphor iron. To, for instance, obtain a dust core that is an alternate to a core so far manufactured using a ply silicon steel sheet and used for relatively low-frequency applications, it is preferable to use an iron powder having high saturation magnetization. The iron powder may be produced by any one of an atomization process, an electrolytic process, and a process for mechanically pulverizing electrolytic iron.

When an alloy system is used for the ferromagnetic metal powders, it must be annealed at higher temperatures because alloy particles are harder than iron particles and so large stresses are applied thereto during molding. Accordingly, the effect of the invention on the retention of insulation at higher annealing temperatures becomes ever stronger.

The ferromagnetic metal powders should have an average particle size of preferably 50 to 200 $\mu$m, and more preferably 50 to 150 $\mu$m. With too small an average particle size, coercive force becomes large, and with too large an average particle size, eddy current loss become large. It is here noted that the ferromagnetic metal powders having an average particle size within such a range may be obtained by classification using a sieve or the like.

In the invention, the ferromagnetic metal particles may be flattened if required. Flattening is particularly effective for a core obtained by a so-called transverse molding process wherein molding is carried out while pressure is applied in a direction vertical to a magnetic path through the core during use, for instance, a toroidal or E core wherein all legs are in a rectangular shape. In other words, with the transverse molding process it is easy to make the major surfaces of flat particles in the dust core substantially parallel with the magnetic path. It is thus possible to use the flat particles, thereby easily enhancing the permeability of the core. No particular limitation is imposed on flattening means; however, it is preferable to use means making use of rolling and shearing actions such as a ball mill, a rod mill, a vibration mill, and an attrition mill. No particular limitation is imposed on the rate of flattening; however, it is usually preferable to achieve an average aspect ratio of about 5 to 25. By the "aspect ratio" used herein is intended a value found by dividing the average value of the length and breadth of the major surface by thickness.

Dust Core and its Fabrication Process

The dust core of the invention is obtained by the compression molding of the aforesaid dust core ferromagnetic powders.

For the fabrication of this dust core, the ferromagnetic metal powders are first mixed with the insulating material.

When iron powders are used as the ferromagnetic metal powders, they should preferably be thermally treated (or annealed) for stress removal before mixing. Prior to mixing, the iron powders may have been oxidized. If thin oxidized films of the order of a few tens of nanometers are formed by this oxidization treatment in the vicinities of the surfaces of the iron particles, insulation improvements are then expectable. The oxidization treatment may be carried out at about 150 to 300° C. for about 0.1 to 2 hours in the air or other oxidizing atmosphere. When the iron particles are oxidized, they may be mixed with a dispersant such as ethyl cellulose for the purpose of improving the wettability thereof.

No particular limitation is imposed on mixing conditions; for instance, mixing may be carried out at about room temperature for 20 to 60 minutes using a pressure kneader, an automated mortar or the like. After mixing, it is preferable to carry out drying at about 100 to 300° C. for 20 to 60 minutes.

After drying, the lubricant is added to the dried mixture to obtain dust core ferromagnetic powders.

At the molding step, the ferromagnetic powders are molded into a desired core shape. No particular limitation is imposed on core shape; that is, the invention may be applied to the fabrication of cores of various shapes, e.g., so-called toroidal cores, E cores, I cores, F cores, C cores, EE cores, EI cores, ER cores, EPC cores, pot cores, drum cores, and cup cores. In addition, the dust core of the invention may be formed into a core of complex shape.

No particular limitation is imposed on molding conditions; they may be appropriately determined depending on the type and shape of the ferromagnetic metal particles, the desired core shape, size and density, etc. Usually, however, it is preferable that the ferromagnetic powders are molded at a maximum pressure of about 6 to 20 t/cm$^2$ while they are held at the maximum pressure for about 0.1 second to 1 minute.

After compaction, the dust core compact is thermally treated (or annealed) to improve the magnetic characteristics of the dust core. This thermal treatment is provided to release stresses induced during pulverization and molding from the ferromagnetic metal particles. When the particles are mechanically flattened, stress induced thereby, too, may be released therefrom. In addition, the thermal treatment enables the insulating resin to be so cured that the mechanical strength of the core compact can be improved.

The thermal treatment conditions may be appropriately determined depending on the type of the ferromagnetic metal powders, the molding conditions, the flattening conditions, etc. However, the thermal treatment should be carried out at preferably 550 to 850° C., and more preferably 600 to 800° C. At too low a treatment temperature, the release of stresses becomes insufficient, and so the return of coercive force to its own state becomes insufficient, resulting in decreased permeability and increased hysteresis losses. At too high a treatment temperature, on the other hand, the insulating coatings break down thermally, resulting in poor insulation and, hence, increased eddy current loss. The treating time, i.e., the length of time during which the dust core compact is exposed to the above range of treatment temperatures or the length of time during which the dust core compact is held at a certain temperature within the above range of temperatures should preferably be 10 minutes to 2 hours. Too short a treating time causes the annealing effect to tend to become insufficient, and too long makes the breakdown of the insulating coatings likely to occur.

To prevent permeability and magnetic flux density drops due to the oxidization of the ferromagnetic metal powders, the thermal treatment should preferably be carried out in a nitrogen, argon, hydrogen or other non-oxidizing atmosphere.

After the thermal treatment, the core may be impregnated with resin or the like if required. This resin impregnation is effective for further strength improvements. The resin used for the impregnation, for instance, includes phenol resin, epoxy resin, silicone resin, and acrylic resin, among which the phenol resin is most preferred. For use, these resins may be dissolved in a solvent such as ethanol, acetone, toluene, and pyrrolidone.

To impregnate the core with the resin, for instance, the core is placed on a vessel such as a butt. Then, a mixed resin and solvent solution (e.g., a solution of 10% phenol resin in ethanol) is cast in the vessel to provide perfect concealment of the core. After the core is held at this state for about 1 to 30 minutes, the core is taken out of the vessel to remove the resin solution deposited around the core to some degrees. Then, the core is heated. For this heating treatment, the core is first heated in an oven or the like to about 80 to 120° C. in the air, at which the core is held for about 1 to 2 hours. Then, the core is heated to about 130 to 170° C. at which it is held for about 1.5 to 3 hours. After this, the core is cooled down to about 100 to 60° C. at which it is held for about 0.5 to 2 hours.

After the heat treatment, an insulating coating is formed on the surface of the core so as to ensure insulation between windings, if required. Then, wires are wound around core halves, and the core halves are assembled together for encasing.

The dust core of the invention is suitable for magnetic cores of transformers, inductors, etc., cores for motors, and other electromagnetic parts. Also, the dust core may be used for choking coils of electric cars, sensors for air bugs, etc. The dust core of the invention may be used at a frequency of preferably 10 Hz to 500 kHz, and more preferably 500 Hz to 200 kHz.

EXAMPLE

Example 1

Dust core samples were prepared accoridng to the following procedure.

For the ferromagnetic metal powders, permalloy powders (made by Daido Steel Co., Ltd. and having an average particle size of 50 $\mu$m) were used. For the insulating material, a zirconia sol (a dispersion obtained by regulating a $ZrO_2$ sol (NZS-30A made by Nissan Chemical Industries, Ltd. and having an average particle size of 62 nm) to pH 7 and substituting an aqueous solvent by an ethanol solvent), and a phenol resin were used. It is here noted that the phenol resin was a resol type resin (ELS-582 made by Showa Kobunshi Co., Ltd. and having a weight-average molecular weight of 1,500). For the lubricant, use was made of magnesium, barium, calcium and strontium salts of stearic acid (all made by Sakai Chemical Industries, Ltd.), zinc stearate (made by Nitto Kako Co., Ltd.), and stearic acid (first-class reagent made by Junsei Kagaku Co., Ltd.). The amount, as calculated on a solid basis, of the zirconia sol added was 2.0% by volume relative to the ferromagnetic metal powders. The amounts of the resins and lubricants added to the ferromagnetic metal powders are shown in Table 1.

First, the ferromagnetic metal powders and insulating material were mixed together at room temperature for 30 minutes, using a pressure kneader, and dried at 250° C. for 30 minutes in the air. Then, the lubricant was added to the mixture for a 15-minute mixing in a V mixer. The mixture was molded at a pressure of 12 t/cm$^2$ into a toroidal shape of 17.5 mm in outer diameter, 10.2 mm in inner diameter and about 6 mm in height.

After molding, the resultant dust core compacts were thermally treated in an $N_2$ atmosphere at the temperatures shown in Table 1 for 30 minutes to obtain dust core samples.

Each sample was measured for permeability ($\mu$) at 100 kHz, and core losses at 100 kHz and 100 mT (hysteresis loss (Ph), eddy current loss (Pe) and total loss (Pc)). It is here noted that the permeability was measured by means of an LCR meter (HP4284A made by Yokokawa Hewlett-Packard Co., Ltd.) and the core losses were measured by means of a B-H analyzer (SY-8232 made by Iwasaki Tsushinki Co., Ltd.). The results are set out in Table 1.

TABLE 1

| Sample | | Amount of Lub. | | Amount of Resin | Thermal Treatment | $\mu$100 | Core Losses (kW/m$^3$) | | |
|---|---|---|---|---|---|---|---|---|---|
| No. | Lubricant | weight % | Resin | volume % | Temp. ° C. | kHz | Pc | Ph | Pe |
| 101 | magnesium stearate | 0.5 | phenol | 7.1 | 750 | 132 | 1341 | 812 | 529 |
| 102 | calcium stearate | 0.5 | phenol | 7.1 | 750 | 134 | 1380 | 816 | 564 |
| 103 | barium stearate | 0.5 | phenol | 7.1 | 750 | 136 | 1343 | 794 | 549 |

TABLE 1-continued

| Sample No. | | Lubricant | Amount of Lub. weight % | Resin | Amount of Resin volume % | Thermal Treatment Temp. ° C. | μ100 kHz | Core Losses (kW/m³) Pc | Ph | Pe |
|---|---|---|---|---|---|---|---|---|---|---|
| 104 | | strontium stearate | 0.5 | phenol | 7.1 | 750 | 131 | 1122 | 814 | 308 |
| 105 | (comp.) | zinc stearate | 0.5 | phenol | 7.1 | 750 | 108 | 1734 | 818 | 916 |
| 106 | (comp.) | stearic acid | 0.5 | phenol | 7.1 | 750 | 94 | 7787 | 1615 | 6172 |
| 107 | (comp.) | strontium stearate | 0.5 | phenol | 7.1 | 500 | 78 | 3485 | 3180 | 305 |
| 108 | (comp.) | strontium stearate | 0.5 | phenol | 7.1 | 900 | 63 | 6910 | 1050 | 5860 |
| 109 | | strontium stearate | 0.1* | phenol | 7.1 | 750 | 98 | 4780 | 850 | 3930 |
| 110 | | strontium stearate | 0.3 | phenol | 7.1 | 750 | 128 | 1188 | 825 | 363 |
| 111 | | strontium stearate | 1.0 | phenol | 7.1 | 750 | 121 | 1142 | 834 | 308 |
| 112 | | strontium stearate | 1.8* | phenol | 7.1 | 750 | 79 | 1271 | 938 | 333 |

*indicates deviations from the preferable range.

The advantages of the inventive samples over the comparative sample are clearly understood from Table 1. That is, the inventive samples containing the aforesaid specific divalent metal salts of stearic acid as the lubricant are all high in terms of permeability at 100 kHz and low in terms of hysteresis loss and eddy current loss. However, both sample No. 105 using zinc stearate as the lubricant and sample No. 106 using stearic acid as the lubricant are low in terms of permeability. Moreover, No. 105 shows increased losses.

Sample No. 107 thermally treated at 500° C. shows decreased permeability and increased hysteresis loss due to insufficient release of stresses. On the other hand, sample No. 108 thermally treated at 900° C. shows increased eddy current loss and decreased permeability due to poor insulation.

By examination of resin losses at thermal treatment temperatures of 550° C. or higher, it is found that the inventive samples are more reduced than the comparative sample with zinc stearate added thereto by at least 10 percentage points.

Example 2

Dust core samples were prepared as in Example 1 with the exception that electrolytic iron powders (made by Furukawa Kikai Kinzoku Co., Ltd. and having an average particle size of 110 μm) were used as the ferromagnetic metal powders, a silicone resin (KR153 made by The Shin-Etsu Chemical Co., Ltd. and having a weight-average molecular weight of 2,600 and a resin loss of about 30% at around 600° C.) was used in place of the phenol resin, and the thermal treatment was carried out for 60 minutes. Shown in Table 2 are the lubricants used for the samples and their amounts, the resin used for the samples and its amount, and the thermal treatment temperature.

These samples were measured for characteristics as in Example 1. However, permeability (μ) was measured at 1 kHz and core losses were measured at 1 kHz and 1,000 mT. The results are set out in Table 2.

TABLE 2

| Sample No. | | Lubricant | Amount of Lub. weight % | Resin | Amount of Resin volume % | Thermal Treatment Temp. ° C. | μ1 kHz | Core Losses (kW/m³) Pc | Ph | Pe |
|---|---|---|---|---|---|---|---|---|---|---|
| 201 | | magnesium stearate | 0.2 | silicone | 2.4 | 600 | 329 | 593 | 464 | 129 |
| 202 | | calcium stearate | 0.2 | silicone | 2.4 | 600 | 325 | 574 | 450 | 124 |
| 203 | | barium stearate | 0.2 | silicone | 2.4 | 600 | 323 | 585 | 465 | 120 |
| 204 | | strontium stearate | 0.2 | silicone | 2.4 | 600 | 324 | 568 | 452 | 116 |
| 205 | (comp.) | zinc stearate | 0.2 | silicone | 2.4 | 600 | 293 | 695 | 493 | 202 |
| 206 | (comp.) | stearic acid | 0.2 | silicone | 2.4 | 600 | 251 | 884 | 530 | 354 |

From Table 2, it is found that the advantages of the invention are also achievable at a frequency of 1 kHz.

According to the invention, it is possible to achieve a dust core having high saturation magnetic flux density, low losses, and satisfactory permeability with its dependence on frequency being improved.

Japanese Patent Application No. 10-228668 is herein incorporated by reference.

Although some preferred embodiments have been described, many modifications and variations may be made thereto in the light of the above teachings. It is therefore to be understood that within the scope of the appended claims, the invention may be practiced otherwise than as specifically described.

What we claim is:

1. A dust core ferromagnetic powder comprising a ferromagnetic metal powder, an insulating material, a sol, and a lubricant, wherein:

said insulating material comprises a phenol resin and/or a silicone resin, and said sol is selected from the group consisting of titanium oxide sol, zirconium oxide sol, and mixtures thereof, and said lubricant comprises at least one compound selected from the group consisting of magnesium stearate, calcium stearate, strontium stearate, and barium stearate.

2. A dust core, which is obtained by compression molding of the dust core ferromagnetic powder as recited in claim 1.

3. A dust core fabrication process which comprises the steps of:

compression molding the dust core ferromagnetic powder of claim 1 to form a ferromagnetic core compact, and thermally treating the ferromagnetic core compact at 550 to 850° C.

4. A dust core fabrication process which comprises steps of:

subjecting a dust core ferromagnetic powder comprising a ferromagnetic metal powder, an insulating material, and a lubricant, wherein said insulating material comprises a phenol resin and/or a silicone resin, and said lubricant comprises at least one compound selected from the group consisting of magnesium stearate, calcium stearate, strontium stearate, and barium stearate to compression molding to form a ferromagnetic core compact, and thermally treating the ferromagnetic core compact at 550 to 850° C.

5. A dust core ferromagnetic powder comprising a ferromagnetic metal alloy powder, an insulating material, and a lubricant, wherein:

said insulating material comprises a phenol resin and/or a silicone resin, and said lubricant comprises at least one compound selected from the group consisting of magnesium stearate, calcium stearate, strontium stearate, and barium stearate.

6. The dust core ferromagnetic powder according to claim 5, which further comprises a titanium oxide sol and/or a zirconium oxide sol.

7. A dust core obtained by compression molding the dust core ferromagnetic powder of claim 5.

8. A dust core obtained by compression molding the dust core ferromagnetic powder of claim 6.

9. A dust core prepared by the fabrication process of claim 3.

10. A dust core prepared by the fabrication process of claim 4.

11. A dust core ferromagnetic powder comprising a ferromagnetic metal powder, an insulating material, and a lubricant, wherein:

said insulating material comprises a phenol resin and/or a silicone resin, and said lubricant comprises at least one compound selected from the group consisting of magnesium stearate, strontium stearate, and barium stearate.

12. The dust core ferromagnetic powder of claim 11 which further comprises a titanium oxide sol and or a zirconium oxide sol.

13. A dust core, obtained by compression molding the dust core ferromagnetic powder of claim 11.

14. A dust core fabrication process which comprises the steps of:

compression molding the dust core ferromagnetic powder of claim 11 to form a ferromagnetic core compact, and thermally treating the ferromagnetic core compact at 550 to 850° C.

* * * * *